US006935929B2

(12) United States Patent
Elledge

(10) Patent No.: US 6,935,929 B2
(45) Date of Patent: Aug. 30, 2005

(54) POLISHING MACHINES INCLUDING UNDER-PADS AND METHODS FOR MECHANICAL AND/OR CHEMICAL-MECHANICAL POLISHING OF MICROFEATURE WORKPIECES

(75) Inventor: Jason B. Elledge, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/425,467

(22) Filed: Apr. 28, 2003

(65) Prior Publication Data

US 2004/0214514 A1 Oct. 28, 2004

(51) Int. Cl.[7] ..... B24B 1/00; B24B 7/00

(52) U.S. Cl. ..... 451/41; 451/59; 451/288; 451/495; 451/527; 451/550

(58) Field of Search ..... 451/41, 57, 59, 451/63, 65, 66, 285, 286, 287, 288, 289, 290, 527, 529, 548, 550

(56) References Cited

U.S. PATENT DOCUMENTS

| | | | |
|---|---|---|---|
| 5,020,283 | A | 6/1991 | Tuttle |
| 5,069,002 | A | 12/1991 | Sandhu et al. |
| 5,081,796 | A | 1/1992 | Schultz |
| 5,177,908 | A | 1/1993 | Tuttle |
| 5,222,875 | A | 6/1993 | Clark |
| 5,232,875 | A | 8/1993 | Tuttle et al. |
| 5,234,867 | A | 8/1993 | Schultz et al. |
| 5,240,552 | A | 8/1993 | Yu et al. |
| 5,244,534 | A | 9/1993 | Yu et al. |
| 5,245,790 | A | 9/1993 | Jerbic |
| 5,245,796 | A | 9/1993 | Miller et al. |
| RE34,425 | E | 11/1993 | Schultz |
| 5,297,364 | A | 3/1994 | Tuttle |
| 5,421,769 | A | 6/1995 | Schultz et al. |
| 5,433,651 | A | 7/1995 | Lustig et al. |
| 5,449,314 | A | 9/1995 | Meikle et al. |
| 5,486,129 | A | 1/1996 | Sandhu et al. |
| 5,514,245 | A | 5/1996 | Doan et al. |
| 5,533,924 | A | 7/1996 | Stroupe et al. |
| 5,540,810 | A | 7/1996 | Sandhu et al. |
| 5,609,718 | A | 3/1997 | Meikle |
| 5,618,381 | A | 4/1997 | Doan et al. |
| 5,618,447 | A | 4/1997 | Sandhu |
| 5,624,303 | A | 4/1997 | Robinson |
| 5,643,053 | A | 7/1997 | Shendon |

(Continued)

FOREIGN PATENT DOCUMENTS

DE 198 07 948 A1 8/1999

OTHER PUBLICATIONS

U.S. Appl. No. 10/346,233, filed Jan. 16, 2003, Elledge.
U.S. Appl. No. 10/226,571, filed Aug. 23, 2002, Chandrasekaran.

(Continued)

*Primary Examiner*—Timothy V. Eley
(74) *Attorney, Agent, or Firm*—Perkins Coie LLP

(57) ABSTRACT

Polishing machines and methods for mechanical and/or chemical-mechanical polishing of microfeature workpieces are disclosed herein. In one embodiment, a machine includes a table having a support surface, an under-pad carried by the support surface, and a workpiece carrier assembly over the table. The under-pad has a cavity and the carrier assembly is configured to carry a microfeature workpiece. The machine further includes a magnetic field source configured to generate a magnetic field in the cavity and a magnetorheological fluid in the cavity. The magnetorheological fluid changes viscosity within the cavity under the influence of the magnetic field source. It is emphasized that this Abstract is provided to comply with the rules requiring an abstract. It is submitted with the understanding that it will not be used to interpret or limit the scope or meaning of the claims. 37 C.F.R §172 (b).

44 Claims, 7 Drawing Sheets

U.S. PATENT DOCUMENTS

| | | | |
|---|---|---|---|
| 5,643,060 A | 7/1997 | Sandhu et al. | |
| 5,658,183 A | 8/1997 | Sandhu et al. | |
| 5,658,186 A | 8/1997 | Perrotto et al. | |
| 5,658,190 A | 8/1997 | Wright et al. | |
| 5,664,988 A | 9/1997 | Stroupe et al. | |
| 5,679,065 A | 10/1997 | Henderson | |
| 5,681,215 A | 10/1997 | Sherwood et al. | |
| 5,690,540 A | 11/1997 | Elliott et al. | |
| 5,700,180 A | 12/1997 | Sandhu et al. | |
| 5,702,292 A | 12/1997 | Brunelli et al. | |
| 5,730,642 A | 3/1998 | Sandhu et al. | |
| 5,733,176 A | 3/1998 | Robinson et al. | |
| 5,736,427 A | 4/1998 | Henderson | |
| 5,738,567 A | 4/1998 | Manzonie et al. | |
| 5,747,386 A | 5/1998 | Moore | |
| 5,792,709 A | 8/1998 | Robinson et al. | |
| 5,795,218 A | 8/1998 | Doan et al. | |
| 5,795,495 A | 8/1998 | Meikle | |
| 5,807,165 A | 9/1998 | Uzoh et al. | |
| 5,823,855 A | 10/1998 | Robinson | |
| 5,830,806 A | 11/1998 | Hudson et al. | |
| 5,836,807 A | 11/1998 | Leach | |
| 5,842,909 A | 12/1998 | Sandhu et al. | |
| 5,851,135 A | 12/1998 | Sandhu et al. | |
| 5,868,896 A | 2/1999 | Robinson et al. | |
| 5,871,392 A | 2/1999 | Meikle et al. | |
| 5,879,222 A | 3/1999 | Robinson | |
| 5,882,248 A | 3/1999 | Wright et al. | |
| 5,893,754 A | 4/1999 | Robinson et al. | |
| 5,895,550 A | 4/1999 | Andreas | |
| 5,910,043 A | 6/1999 | Manzonie et al. | |
| 5,916,012 A | 6/1999 | Pant et al. | |
| 5,919,082 A | 7/1999 | Walker et al. | |
| 5,930,699 A | 7/1999 | Bhatia | |
| 5,931,718 A | 8/1999 | Komanduri et al. | |
| 5,931,719 A | 8/1999 | Nagahara et al. | |
| 5,934,980 A | 8/1999 | Koos et al. | |
| 5,936,733 A | 8/1999 | Sandhu et al. | |
| 5,938,801 A | 8/1999 | Robinson | |
| 5,945,347 A | 8/1999 | Wright | |
| 5,954,912 A | 9/1999 | Moore | |
| 5,967,030 A | 10/1999 | Blalock | |
| 5,972,792 A | 10/1999 | Hudson | |
| 5,976,000 A | 11/1999 | Hudson | |
| 5,980,363 A | 11/1999 | Meikle et al. | |
| 5,981,396 A | 11/1999 | Robinson et al. | |
| 5,989,470 A | 11/1999 | Doan et al. | |
| 5,990,012 A | 11/1999 | Robinson et al. | |
| 5,994,224 A | 11/1999 | Sandhu et al. | |
| 5,997,384 A | 12/1999 | Blalock | |
| 6,036,586 A | 3/2000 | Ward | |
| 6,039,633 A | 3/2000 | Chopra | |
| 6,040,245 A | 3/2000 | Sandhu et al. | |
| 6,054,015 A | 4/2000 | Brunelli et al. | |
| 6,059,638 A | 5/2000 | Crevasse et al. | |
| 6,062,958 A | 5/2000 | Wright et al. | |
| 6,066,030 A | 5/2000 | Uzoh | |
| 6,074,286 A | 6/2000 | Ball | |
| 6,083,085 A | 7/2000 | Lankford | |
| 6,090,475 A | 7/2000 | Robinson et al. | |
| 6,110,820 A | 8/2000 | Sandhu et al. | |
| 6,113,467 A | 9/2000 | Koike | |
| 6,116,988 A | 9/2000 | Ball | |
| 6,120,354 A | 9/2000 | Koos et al. | |
| 6,135,856 A | 10/2000 | Tjaden et al. | |
| 6,136,043 A | 10/2000 | Robinson et al. | |
| 6,139,402 A | 10/2000 | Moore | |
| 6,143,123 A | 11/2000 | Robinson et al. | |
| 6,143,155 A | 11/2000 | Adams et al. | |
| 6,152,808 A | 11/2000 | Moore | |
| 6,176,763 B1 | 1/2001 | Kramer et al. | |
| 6,176,992 B1 | 1/2001 | Talieh | |
| 6,180,525 B1 | 1/2001 | Morgan | |
| 6,186,870 B1 | 2/2001 | Wright et al. | |
| 6,187,681 B1 | 2/2001 | Moore | |
| 6,191,037 B1 | 2/2001 | Robinson et al. | |
| 6,193,588 B1 | 2/2001 | Carlson et al. | |
| 6,196,899 B1 | 3/2001 | Chopra et al. | |
| 6,200,901 B1 | 3/2001 | Hudson et al. | |
| 6,203,404 B1 | 3/2001 | Joslyn et al. | |
| 6,203,407 B1 | 3/2001 | Robinson | |
| 6,203,413 B1 | 3/2001 | Skrovan | |
| 6,206,754 B1 | 3/2001 | Moore | |
| 6,206,756 B1 | 3/2001 | Chopra et al. | |
| 6,206,759 B1 | 3/2001 | Agarwal et al. | |
| 6,210,257 B1 | 4/2001 | Carlson | |
| 6,213,845 B1 | 4/2001 | Elledge | |
| 6,218,316 B1 | 4/2001 | Marsh | |
| 6,220,934 B1 | 4/2001 | Sharples et al. | |
| 6,224,466 B1 | 5/2001 | Walker et al. | |
| 6,227,955 B1 | 5/2001 | Custer et al. | |
| 6,234,868 B1 | 5/2001 | Easter et al. | |
| 6,234,874 B1 | 5/2001 | Ball | |
| 6,234,877 B1 | 5/2001 | Koos et al. | |
| 6,234,878 B1 | 5/2001 | Moore | |
| 6,237,483 B1 | 5/2001 | Blalock | |
| 6,244,944 B1 | 6/2001 | Elledge | |
| 6,250,994 B1 | 6/2001 | Chopra et al. | |
| 6,251,785 B1 | 6/2001 | Wright | |
| 6,254,460 B1 | 7/2001 | Walker et al. | |
| 6,261,151 B1 | 7/2001 | Sandhu et al. | |
| 6,261,163 B1 | 7/2001 | Walker et al. | |
| 6,267,650 B1 | 7/2001 | Hembree | |
| 6,273,786 B1 | 8/2001 | Chopra et al. | |
| 6,273,796 B1 | 8/2001 | Moore | |
| 6,273,800 B1 | 8/2001 | Walker et al. | |
| 6,276,996 B1 | 8/2001 | Chopra | |
| 6,277,015 B1 | 8/2001 | Robinson et al. | |
| 6,284,660 B1 | 9/2001 | Doan | |
| 6,290,579 B1 | 9/2001 | Walker et al. | |
| 6,296,557 B1 | 10/2001 | Walker | |
| 6,297,159 B1 * | 10/2001 | Paton | 438/693 |
| 6,306,012 B1 | 10/2001 | Sabde | |
| 6,306,014 B1 | 10/2001 | Walker et al. | |
| 6,306,768 B1 | 10/2001 | Klein | |
| 6,309,282 B1 | 10/2001 | Wright et al. | |
| 6,312,558 B2 | 11/2001 | Moore | |
| 6,313,038 B1 | 11/2001 | Chopra et al. | |
| 6,325,702 B2 | 12/2001 | Robinson | |
| 6,328,632 B1 | 12/2001 | Chopra | |
| 6,331,135 B1 | 12/2001 | Sabde et al. | |
| 6,331,139 B2 | 12/2001 | Walker et al. | |
| 6,331,488 B1 | 12/2001 | Doan et al. | |
| 6,338,667 B2 | 1/2002 | Sandhu et al. | |
| 6,350,180 B2 | 2/2002 | Southwick | |
| 6,350,691 B1 | 2/2002 | Lankford | |
| 6,352,466 B1 | 3/2002 | Moore | |
| 6,354,919 B2 | 3/2002 | Chopra | |
| 6,354,923 B1 | 3/2002 | Lankford | |
| 6,354,928 B1 | 3/2002 | Crevasse et al. | |
| 6,354,930 B1 | 3/2002 | Moore | |
| 6,358,118 B1 | 3/2002 | Boehm et al. | |
| 6,358,122 B1 | 3/2002 | Sabde et al. | |
| 6,358,127 B1 | 3/2002 | Carlson et al. | |
| 6,358,129 B2 | 3/2002 | Dow | |
| 6,361,400 B2 | 3/2002 | Southwick | |
| 6,361,417 B2 | 3/2002 | Walker et al. | |
| 6,361,832 B1 | 3/2002 | Agarwal et al. | |
| 6,364,749 B1 | 4/2002 | Walker | |
| 6,364,757 B2 | 4/2002 | Moore | |
| 6,368,190 B1 | 4/2002 | Easter et al. | |

| | | | | | |
|---|---|---|---|---|---|
| 6,368,193 | B1 | | 4/2002 | Carlson et al. | |
| 6,368,194 | B1 | | 4/2002 | Sharples et al. | |
| 6,368,197 | B2 | | 4/2002 | Elledge | |
| 6,376,381 | B1 | | 4/2002 | Sabde | |
| 6,387,289 | B1 | | 5/2002 | Wright | |
| 6,402,884 | B1 | | 6/2002 | Robinson et al. | |
| 6,402,978 | B1 | | 6/2002 | Levin | |
| 6,409,586 | B2 | | 6/2002 | Walker et al. | |
| 6,436,828 | B1 | | 8/2002 | Chen et al. | |
| 6,447,369 | B1 | | 9/2002 | Moore | |
| 6,482,077 | B1 | * | 11/2002 | Doan et al. | 451/41 |
| 6,579,799 | B2 | | 6/2003 | Chopra et al. | |
| 6,609,947 | B1 | | 8/2003 | Moore | |
| 2004/0077292 | A1 | * | 4/2004 | Kim et al. | 451/5 |

OTHER PUBLICATIONS

Carlson, J. David, "What Makes a Good MR Fluid?" pp. 1–7, 8$^{th}$ Annual International Conference on Electrorheological (ER) Fluids and Magneto–rheological (MR) Suspensions, Nice, France, Jul. 9–13, 2001.

Jolly, Mark R. et al., "Properties and Applications of Commercial Magnetorheological Fluids," 18 pages, SPIE 5th Annual International Symposium on Smart Structures and Materials, San Diego, California, Mar. 15, 1998.

Kondo, S. et al., "Abrasive–Free Polishing for Copper Damascene Interconnection," Journal of The Electrochemical Society, vol. 147, No. 10, pp. 3907–3913, 2000, The Electrochemical Society, Inc.

Lord Corporation, "Commercial Leader in MR Technology," 1 page, retrieved from the Internet on Jun. 14, 2002, <http://www.rheonetic.com>.

Lord Corporation, "Designing with MR Fluids," 5 pages, Engineering Note, Dec. 1999, Cary, North Carolina.

Lord Corporation, "Magnetic Circuit Design," 4 pages, Engineering Note, Nov. 1999, Cary, North Carolina.

Lord Corporation, "Magneto–Rheological Fluids References," 3 pages, retrieved from the Internet on Jun. 14, 2002, <http://www.rheonetic.com/tech_library/mr_fluid.htm>.

Lord Materials Division, "What is the Difference Between MR and ER Fluid?" 6 pages, Cary, North Carolina, presented May 2002.

* cited by examiner

POLISHING MACHINES INCLUDING UNDER-PADS AND METHODS FOR MECHANICAL AND/OR CHEMICAL-MECHANICAL POLISHING OF MICROFEATURE WORKPIECES

TECHNICAL FIELD

The present invention relates to polishing machines and methods for polishing microfeature workpieces. In particular, the present invention relates to mechanical and/or chemical-mechanical polishing of microfeature workpieces with polishing machines that include under-pads.

BACKGROUND

Mechanical and chemical-mechanical planarization ("CMP") processes remove material from the surface of microfeature workpieces in the production of microelectronic devices and other products. FIG. 1 schematically illustrates a rotary CMP machine 10 with a platen 20, a carrier head 30, and a planarizing pad 40. The CMP machine 10 may also include an under-pad 50 between an upper surface 22 of the platen 20 and a lower surface of the planarizing pad 40. The under-pad 50 provides a thermal and mechanical interface between the planarizing pad 40 and the platen 20. A drive assembly 26 rotates the platen 20 (indicated by arrow F) and/or reciprocates the platen 20 back and forth (indicated by arrow G). Since the planarizing pad 40 is attached to the under-pad 50, the planarizing pad 40 moves with the platen 20 during planarization.

The carrier head 30 has a lower surface 32 to which a microfeature workpiece 12 may be attached, or the workpiece 12 may be attached to a resilient pad 34 under the lower surface 32. The carrier head 30 may be a weighted, free-floating wafer carrier, or an actuator assembly 31 may be attached to the carrier head 30 to impart rotational motion to the microfeature workpiece 12 (indicated by arrow J) and/or reciprocate the workpiece 12 back and forth (indicated by arrow I).

The planarizing pad 40 and a planarizing solution 44 define a planarizing medium that mechanically and/or chemically-mechanically removes material from the surface of the microfeature workpiece 12. The planarizing solution 44 may be a conventional CMP slurry with abrasive particles and chemicals that etch and/or oxidize the surface of the microfeature workpiece 12, or the planarizing solution 44 may be a "clean" nonabrasive planarizing solution without abrasive particles. In most CMP applications, abrasive slurries with abrasive particles are used on nonabrasive polishing pads, and clean nonabrasive solutions without abrasive particles are used on fixed-abrasive polishing pads.

To planarize the microfeature workpiece 12 with the CMP machine 10, the carrier head 30 presses the workpiece 12 facedown against the planarizing pad 40. More specifically, the carrier head 30 generally presses the microfeature workpiece 12 against the planarizing solution 44 on a planarizing surface 42 of the planarizing pad 40, and the platen 20 and/or the carrier head 30 moves to rub the workpiece 12 against the planarizing surface 42. As the microfeature workpiece 12 rubs against the planarizing surface 42, the planarizing medium removes material from the face of the workpiece 12. The force generated by friction between the microfeature workpiece 12 and the planarizing pad 40 will, at any given instant, be exerted across the surface of the workpiece 12 primarily in the direction of the relative movement between the workpiece 12 and the planarizing pad 40. A retaining ring 33 can be used to counter this force and hold the microfeature workpiece 12 in position. The frictional force drives the microfeature workpiece 12 against the retaining ring 33, which exerts a counterbalancing force to maintain the workpiece 12 in position.

The CMP process must consistently and accurately produce a uniformly planar surface on workpieces to enable precise fabrication of circuits and photo-patterns. A nonuniform surface can result, for example, when material from one area of a workpiece is removed more quickly than material from another area during CMP processing. In certain applications, the downward pressure of the retaining ring causes the under-pad and the planarizing pad to deform, creating a standing wave inside the retaining ring. Consequently, the planarizing pad removes material more quickly from the region of the workpiece adjacent to the standing wave than from the regions of the workpiece radially outward and inward from the wave. Thus, the CMP process may not produce a planar surface on the workpiece.

One approach to improve the planarity of a workpiece surface is to use a carrier head with interior and exterior bladders that modulate the downward forces on selected areas of the workpiece. These bladders can exert pressure on selected areas of the back side of the workpiece to increase the rate at which material is removed from corresponding areas on the front side. These carrier heads, however, have several drawbacks. For example, the typical bladder has a curved edge that makes it difficult to exert a uniform downward force at the perimeter. Moreover, conventional bladders cover a fairly broad area of the workpiece which limits the ability to localize the downward force on the workpiece. Furthermore, conventional bladders are often filled with compressible air that inhibits precise control of the downward force. In addition, carrier heads with multiple bladders form a complex system that is subject to significant downtime for repair and/or maintenance causing a concomitant reduction in throughput.

Another approach to improve the planarity of a workpiece surface is to use a hard under-pad to reduce the deformation caused by the retaining ring. Hard under-pads, however, increase the frequency of scratches and other defects on the workpiece because particles in the planarizing solution become trapped between the workpiece and the planarizing pad. Thus, there is a need to improve the polishing process to form uniformly planar surfaces on workpieces.

DETAILED DESCRIPTION

A. Overview

Figure 1:
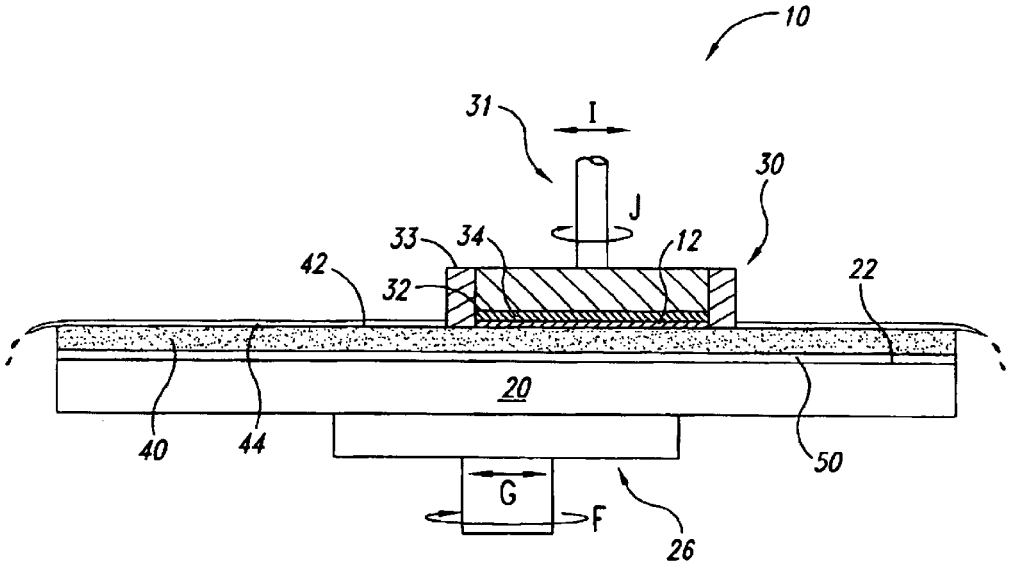
Fig. 1 (Prior Art)
FIG. 1 is a schematic cross-sectional side view of a portion of a rotary planarizing machine in accordance with the prior art.

The present invention is directed toward polishing machines and methods for mechanical and/or chemical-mechanical polishing of microfeature workpieces. The term "microfeature workpiece" is used throughout to include substrates in or on which microelectronic devices, micromechanical devices, data storage elements, and other features are fabricated. For example, microfeature workpieces can be semiconductor wafers, glass substrates, insulated substrates, or many other types of substrates. Furthermore, the terms "planarization" and "planarizing" mean either forming a planar surface and/or forming a smooth surface (e.g., "polishing"). Several specific details of the invention are set forth in the following description and in FIGS. 2–7 to provide a thorough understanding of certain embodiments of the invention. One skilled in the art, however, will understand that the present invention may have additional embodiments, or that other embodiments of the invention may be practiced without several of the specific features explained in the following description.

One aspect of the invention is directed to a polishing machine for mechanical and/or chemical-mechanical polishing of microfeature workpieces. In one embodiment, the machine includes a table having a support surface, an under-pad carried by the support surface, and a workpiece carrier assembly over the table. The under-pad has a cavity and the carrier assembly is configured to carry a microfeature workpiece. The machine further includes a magnetic field source configured to generate a magnetic field in the cavity and a magnetorheological fluid disposed within the cavity. The magnetorheological fluid changes viscosity within the cavity under the influence of the magnetic field source. The change in the viscosity of the magnetorheological fluid changes the compressibility of the under-pad. In one aspect of this embodiment, the magnetic field source is carried by the under-pad, the workpiece carrier assembly, or the table. In another aspect of this embodiment, the under-pad includes a first surface and a second surface, and the cavity is enclosed between the first surface and the second surface.

Another aspect of the invention is directed to an under-pad for use on a polishing machine in the mechanical and/or chemical-mechanical polishing of microfeature workpieces. In one embodiment, the under-pad includes a body having a first surface, a second surface, and a cavity between the first and second surfaces. The first surface is juxtaposed to the second surface. The under-pad further includes a magnetorheological fluid in the cavity. The magnetorheological fluid changes viscosity within the cavity in response to a magnetic field. In one aspect of this embodiment, the cavity includes a plurality of cells arranged generally concentrically, in a grid, or in another pattern. In another aspect of this embodiment, the magnetic field source includes an electrically conductive coil or an electromagnet.

Another aspect of the invention is directed to a method of polishing a microfeature workpiece with a polishing machine having a carrier head, a polishing pad, and an under-pad carrying the polishing pad. In one embodiment, the method includes moving at least one of the carrier head and the polishing pad relative to the other to rub the microfeature workpiece against the polishing pad. The under-pad has a cavity and a magnetorheological fluid disposed within the cavity. The method further includes changing the compressibility of the under-pad by generating a magnetic field to change the viscosity of the magnetorheological fluid within the cavity of the under-pad. In one aspect of this embodiment, generating the magnetic field comprises energizing an electromagnet or an electrically conductive coil.

B. Polishing Systems

Figure 2:
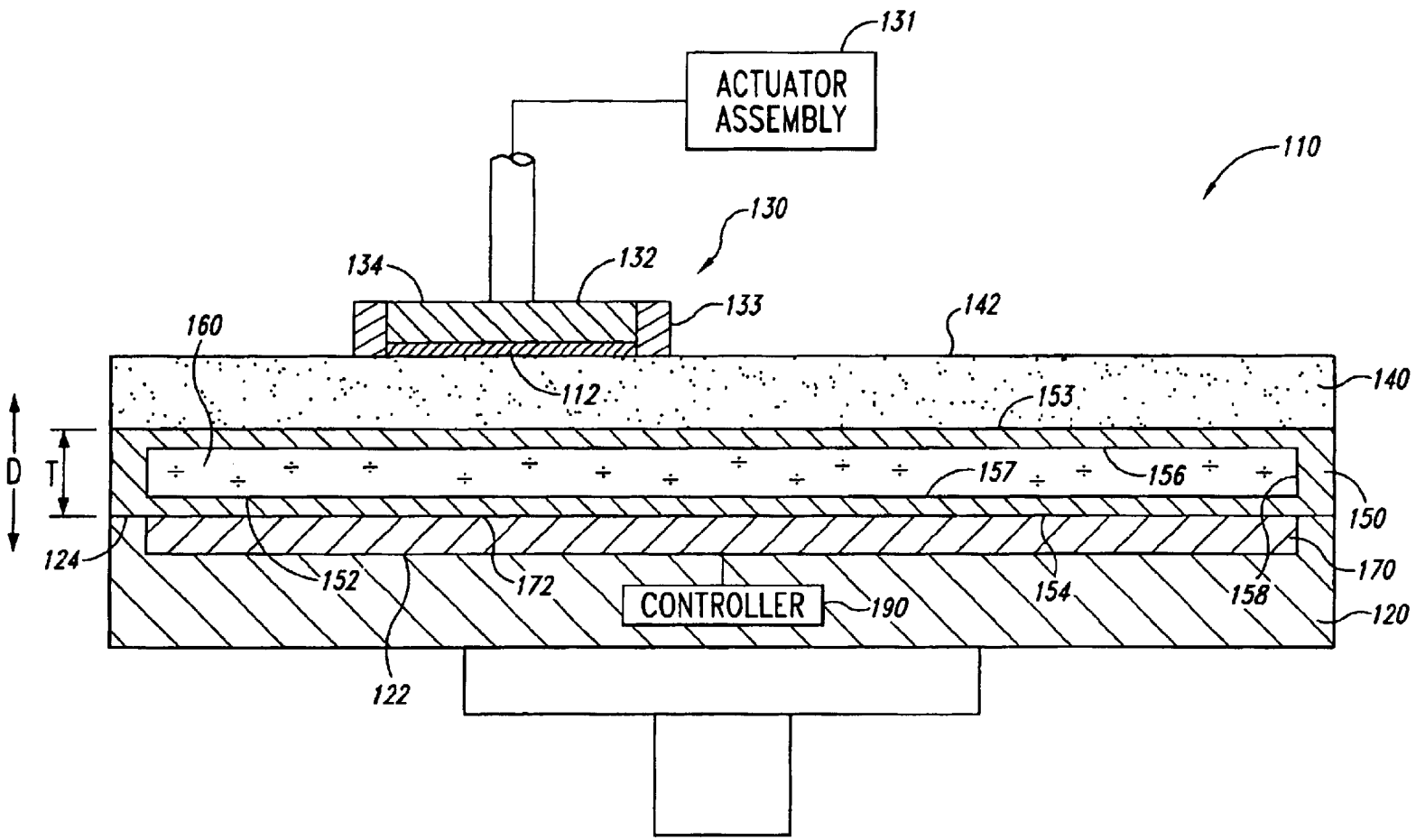
FIG. 2 is a schematic cross-sectional view of a portion of a CMP machine for polishing a microfeature workpiece in accordance with one embodiment of the invention.

FIG. 2 is a schematic cross-sectional view of a CMP machine 110 for polishing a microfeature workpiece 112 in accordance with one embodiment of the invention. The CMP machine 110 includes a platen 120, a workpiece carrier assembly 130 over the platen 120, and a planarizing pad 140 coupled to the platen 120. The workpiece carrier assembly 130 can be coupled to an actuator assembly 131 (shown schematically) to move the workpiece 112 across a planarizing surface 142 of the planarizing pad 140. In the illustrated embodiment, the workpiece carrier assembly 130 includes a head 132 having a support member 134 and a retaining ring 133 coupled to the support member 134. The support member 134 can be an annular housing having an upper plate coupled to the actuator assembly 131. The retaining ring 133 can extend around the support member 134 and project toward the workpiece 112 below a bottom rim of the support member 134.

The CMP machine 110 further includes a dynamic under-pad 150 that dynamically modulates its compressibility to control the polishing rate, defects, planarity, and other characteristics of the polishing process. The under-pad 150 has an upper surface 153 attached to the planarizing pad 140, a lower surface 154 attached to the platen 120, and a cavity 152 between the upper surface 153 and the lower surface 154. The cavity 152 is defined by a first surface 156, a second surface 157 opposite the first surface 156, and an outer surface 158. The cavity 152 is configured to hold a viscosity changing fluid to selectively change the compressibility of the under-pad 150. The under-pad 150 can be manufactured using polymers, rubbers, coated fabrics, composites, and/or any other suitable materials. In one aspect of this embodiment, the under-pad 150 has a thickness T of between approximately 0.5 mm to approximately 10 mm. In other embodiments, the thickness T of the under-pad 150 can be less than 0.5 mm or greater than 10 mm.

In one aspect of this embodiment, the cavity 152 contains a magnetorheological fluid 160 that changes viscosity in response to a magnetic field. For example, the viscosity of the magnetorheological fluid 160 can increase from a viscosity similar to that of motor oil to a viscosity of a nearly solid material depending on the polarity and magnitude of the magnetic field. In additional embodiments, the magnetorheological fluid 160 may experience a smaller change in viscosity in response to the magnetic field and/or the magnetorheological fluid 160 may decrease in viscosity in response to the magnetic field.

The CMP machine 110 further includes a magnetic field source 170 that is configured to generate a magnetic field in the cavity 152 of the under-pad 150. In the illustrated embodiment, the magnetic field source 170 includes an electromagnet that is selectively energized to generate the magnetic field. In other embodiments, such as those described below with reference to FIG. 4, the magnetic field source 170 can be an electrically conductive coil, a magnet, or any other suitable device to generate the magnetic field in the cavity 152. In the illustrated embodiment, the platen 120 includes a depression 122 that receives the magnetic field source 170. Accordingly, an upper surface 172 of the magnetic field source 170 and an upper surface 124 of the platen 120 carry the under-pad 150. In other embodiments, such as those described below with reference to FIGS. 4 and 6, the platen 120 may not carry the magnetic field source 170. For example, the workpiece carrier assembly 130, the planarizing pad 140, and/or the under-pad 150 can carry the magnetic field source 170.

In one aspect of this embodiment, the CMP machine 110 also includes a controller 190 operably coupled to the magnetic field source 170 to selectively energize the magnetic field source 170. The controller 190 selectively energizes the magnetic field source 170, which generates a magnetic field to change the viscosity of the magnetorheological fluid 160 within the cavity 152. As the viscosity of the magnetorheological fluid 160 increases, the compressibility of the under-pad 150 decreases. For example, when the magnetorheological fluid 160 has a high viscosity, the under-pad 150 is relatively inflexible in a direction D. Accordingly, the controller 190 can dynamically control in real time the compressibility of the under-pad 150 by varying the power applied to the magnetic field source 170 before, during, and/or after polishing workpieces.

One embodiment of a process for polishing the workpiece 112 includes a first stage in which the under-pad 150 is generally hard and a second stage in which the under-pad 150 is generally compressible. During the first stage in which the under-pad 150 is hard, the planarizing pad 140 efficiently creates a planar surface on the workpiece 112 without removing excessive amounts of material from the workpiece 112. The hard under-pad 150, however, can create a significant number of defects on the surface of the workpiece 112. For example, the defects can result from particles in the planarizing solution that become trapped between the planarizing pad 140 and the surface of the workpiece 112. During the second stage in which the under-pad 150 is compressible, the planarizing pad 140 removes the defects from the surface of the workpiece 112. Typically, in this embodiment, the under-pad 150 is not compressible during the first stage of the polishing process because a compressible under-pad does not efficiently create a planar surface on the workpiece 112 and can cause dishing in low density areas of the workpiece 112.

One feature of the CMP machine 110 of this embodiment is the ability to change the compressibility of the under-pad in real time during the polishing cycle. An advantage of this feature is the ability to obtain the benefits of polishing the workpiece using a hard under-pad and polishing the workpiece using a compressible under-pad at different stages of planarizing a workpiece. More specifically, the under-pad can efficiently create a planar surface on the workpiece and then remove the defects from the planar surface.

C. Other Configurations of Magnetic Field Sources and Under-Pads

Figure 3A:
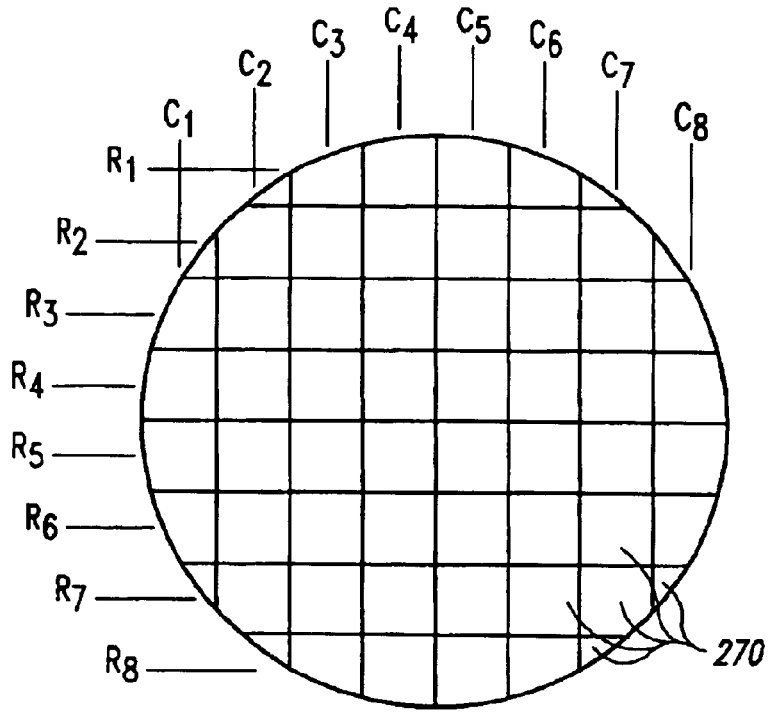
FIG. 3A is a schematic top planform view of a plurality of magnetic field sources for use in a CMP machine in accordance with an additional embodiment of the invention.
Figure 3B:
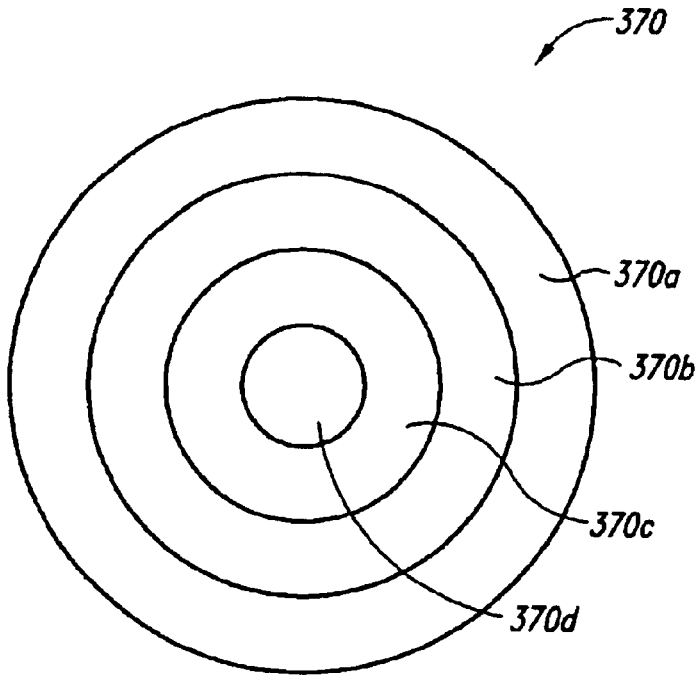
FIG. 3B is a schematic top planform view of a plurality of magnetic field sources for use in a CMP machine in accordance with an additional embodiment of the invention.

FIGS. 3A and 3B are schematic top planform views of several configurations of magnetic field sources for use in CMP machines in accordance with additional embodiments of the invention. For example, FIG. 3A illustrates a plurality of magnetic field sources 270 arranged in a grid with a plurality of rows $R_1$–$R_8$ and a plurality of columns $C_1$–$C_8$. The magnetic field sources proximate to the perimeter can have a curved side that corresponds with the curvature of an under-pad. The magnetic field sources 270 can be operably coupled to a controller to generate magnetic fields in corresponding portions of an under-pad. In additional embodiments, the size of the magnetic field sources 270 can decrease to increase the resolution such that a much larger number of rows and columns can be used.

FIG. 3B is a schematic top planform view of a plurality of magnetic field sources 370 (identified individually as 370*a–d*) in accordance with another embodiment of the invention. A first magnetic field source 370*a*, a second magnetic field source 370*b*, and a third magnetic field source 370*c* have generally annular configurations and are arranged concentrically around a fourth magnetic field source 370*d*. In other embodiments, the magnetic field sources 370 can be spaced apart from each other and/or arranged in other configurations such as in quadrants.

Figure 4:
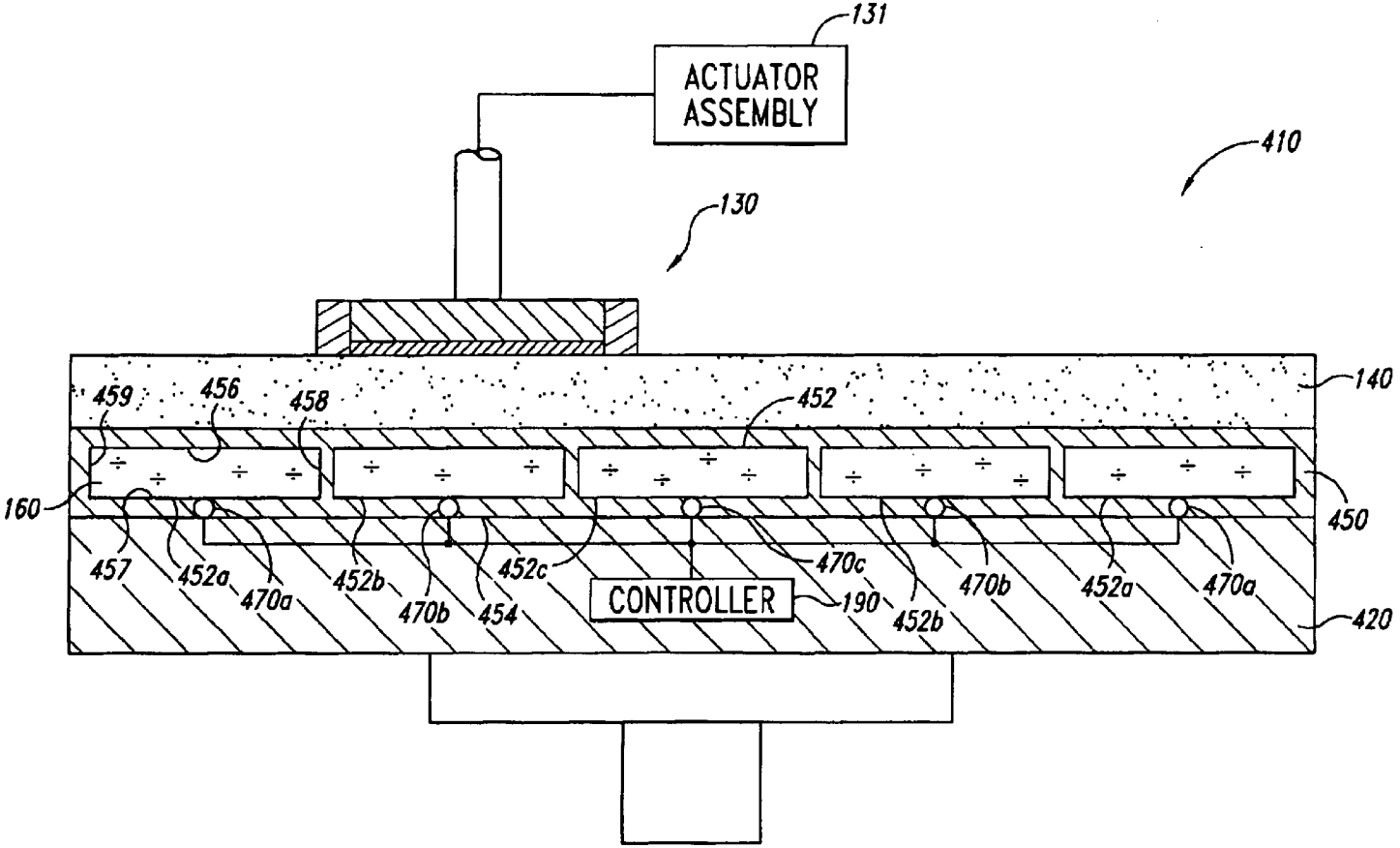
FIG. 4 is a schematic cross-sectional view of a portion of a CMP machine in accordance with another embodiment of the invention.

FIG. 4 is a schematic cross-sectional view of a CMP machine 410 in accordance with another embodiment of the invention. The CMP machine 410 can be similar to the CMP machine 110 discussed above with reference to FIG. 2. For example, the CMP machine 410 includes a platen 420, a workpiece carrier assembly 130 over the platen 420, and a planarizing pad 140 over the platen 420. The CMP machine 410 further includes an under-pad 450 between the platen 420 and the planarizing pad 140. The underpad 450 has a cavity 452 with a plurality of cells 452*a–c* and a magnetorheological fluid 160 disposed within the cells 452*a–c*. A first cell 452*a* and a second cell 452*b* have generally annular configurations and are arranged concentrically around a third cell 452*c*. The cells 452*a–c* are defined by a first surface 456, a second surface 457 opposite the first surface 456, a third surface 458, and a fourth surface 459 opposite the third surface 458. Discrete volumes of the magnetorheological fluid 160 are disposed within the cells 452*a–c*. In other embodiments, such as those described below with reference to FIG. 5, an under-pad can include a different number of cells and/or the cells can be arranged in a different configuration.

The CMP machine 410 also includes a plurality of magnetic field sources 470 (identified individually as 470*a–c*) carried by the under-pad 450. The magnetic field sources 470 are positioned to selectively generate magnetic fields in corresponding cells 452*a–c*. For example, a first magnetic field source 470*a* is positioned to generate a magnetic field in the first cell 452*a*. Accordingly, discrete portions of the under-pad 450 can be compressible while other portions of the under-pad 450 are hard. For example, in the embodiment illustrated in FIG. 4, a second magnetic field source 470*b* generates a magnetic field in the second cell 452*b*. Consequently, the region of the under-pad 450 defined by the second cell 452*b* is hard while the regions of the under-pad 450 defined by the first and third cells 452*a* and 452*c* are compressible. In one aspect of the illustrated embodiment, the magnetic field sources 470 are electrically conductive coils embedded in the under-pad 450 between a lower surface 454 and the second surface 457. In other embodiments, a CMP machine may include a different number of magnetic field sources and/or the magnetic field sources may be positioned in other locations in the under-pad. In additional embodiments, the under-pad 450 can be used in conjunction with other configurations and/or types of magnetic field sources, such as magnetic field sources that are carried by the platen as described with reference to FIGS. 2–3B, 6 and 7.

Figure 5:
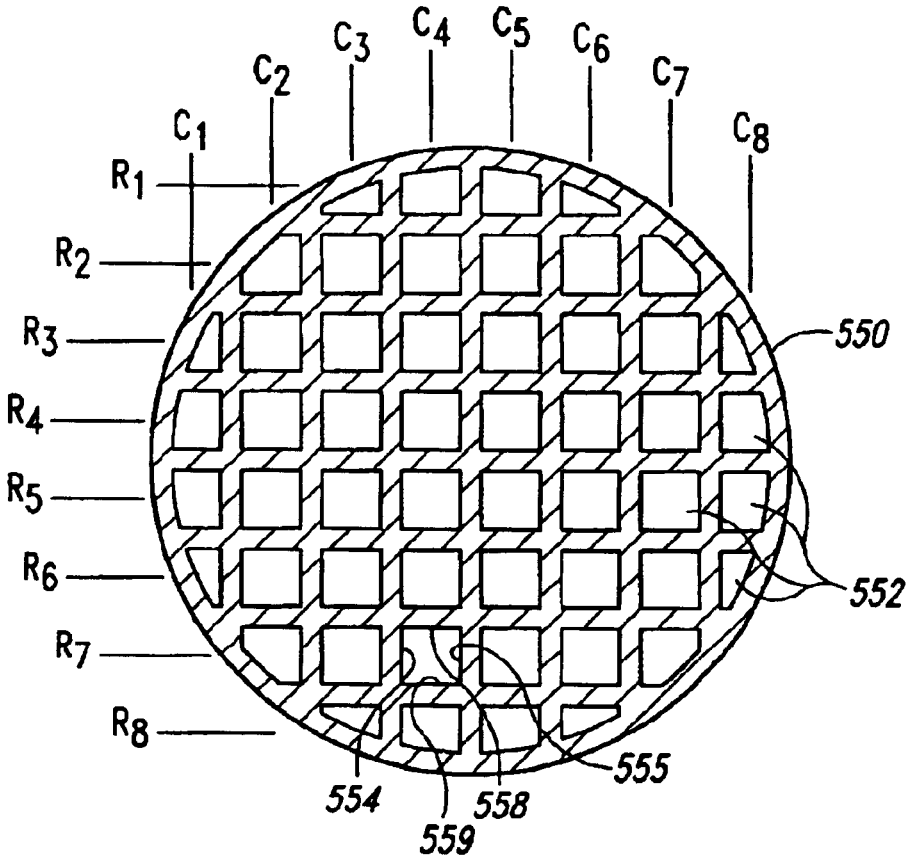
FIG. 5 is a schematic cross-sectional top view of an under-pad in accordance with yet another embodiment of the invention.

FIG. 5 is a schematic cross-sectional top view of an under-pad 550 for use on a CMP machine in accordance with another embodiment of the invention. The under-pad 550 includes a plurality of cells 552 arranged in a grid with a plurality of columns $C_1$–$C_8$ and a plurality of rows $R_1$–$R_8$. The cells 552 are defined by a first surface 554, a second surface 555 opposite the first surface 554, a third surface 558, and a fourth surface 559 opposite the third surface 558. The cells 552 proximate to the perimeter have a curved side that corresponds with the curvature of the under-pad 550. The cells 552 are configured to receive discrete portions of the magnetorheological fluid 160 (FIG. 4). In additional embodiments, the size of the cells 552 can decrease to increase the resolution such that a much larger number of rows and columns can be used.

Figure 6:
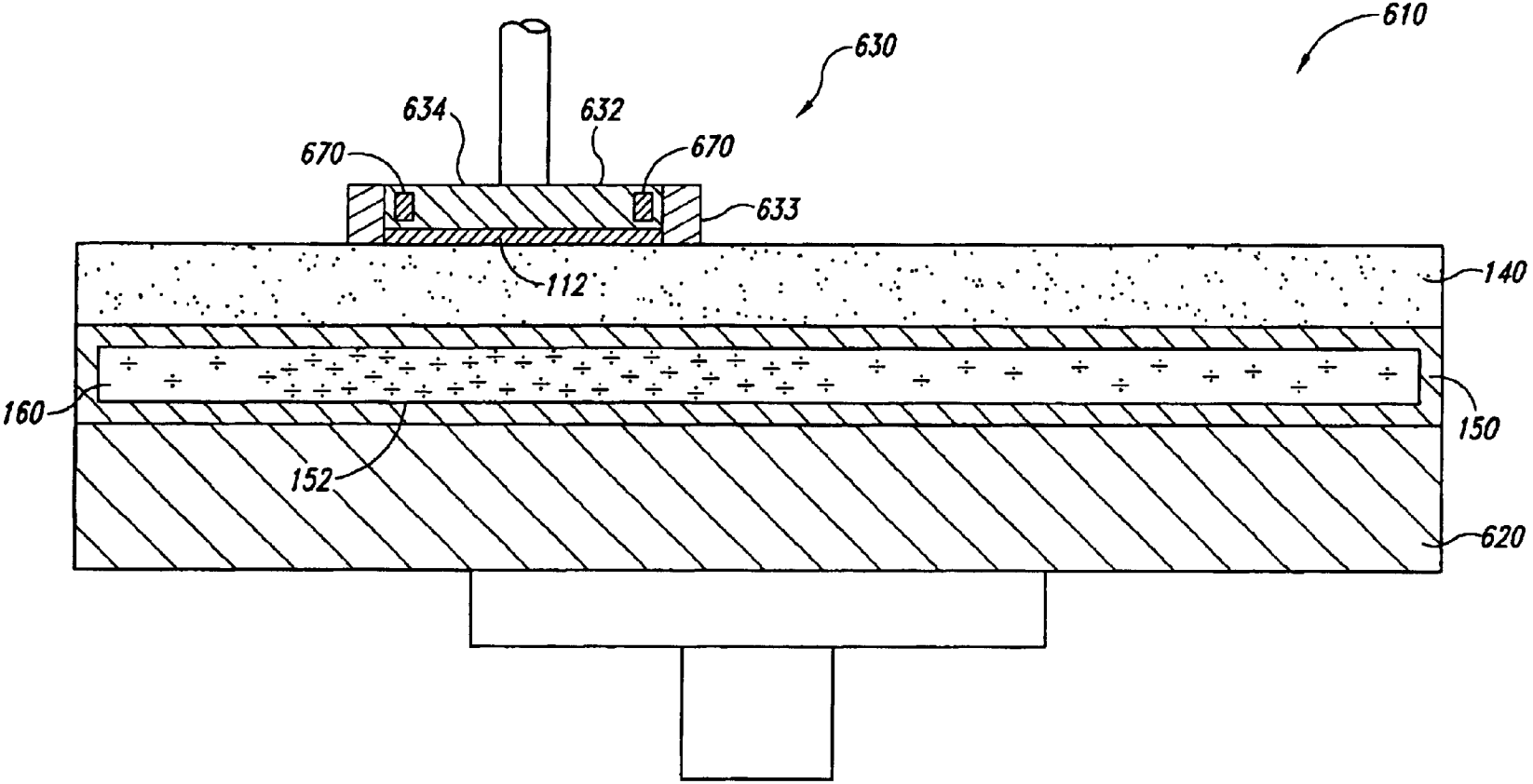
FIG. 6 is a schematic cross-sectional view of a portion of a CMP machine in accordance with still another embodiment of the invention.

FIG. 6 is a schematic cross-sectional view of a CMP machine 610 in accordance with another embodiment of the invention. The CMP machine 610 can be similar to the CMP machine 110 discussed above with reference to FIG. 2. For example, the CMP machine 610 includes a planarizing pad 140, an under-pad 150 carrying the planarizing pad 140, a platen 620 carrying the under-pad 150, and a workpiece carrier assembly 630 over the planarizing pad 140. The under-pad 150 has a cavity 152 containing a magnetorheological fluid 160. The workpiece carrier assembly 630 includes a head 632 having a support member 634 and a retaining ring 633 coupled to the support member 634. The support member 634 can include a plurality of magnetic field sources 670 that are configured to generate magnetic fields in at least a portion of the cavity 152 proximate to the workpiece carrier assembly 630. Accordingly, the CMP machine 610 can selectively control the compressibility of the under-pad 150 proximate to the workpiece carrier assembly 630.

Figure 7:
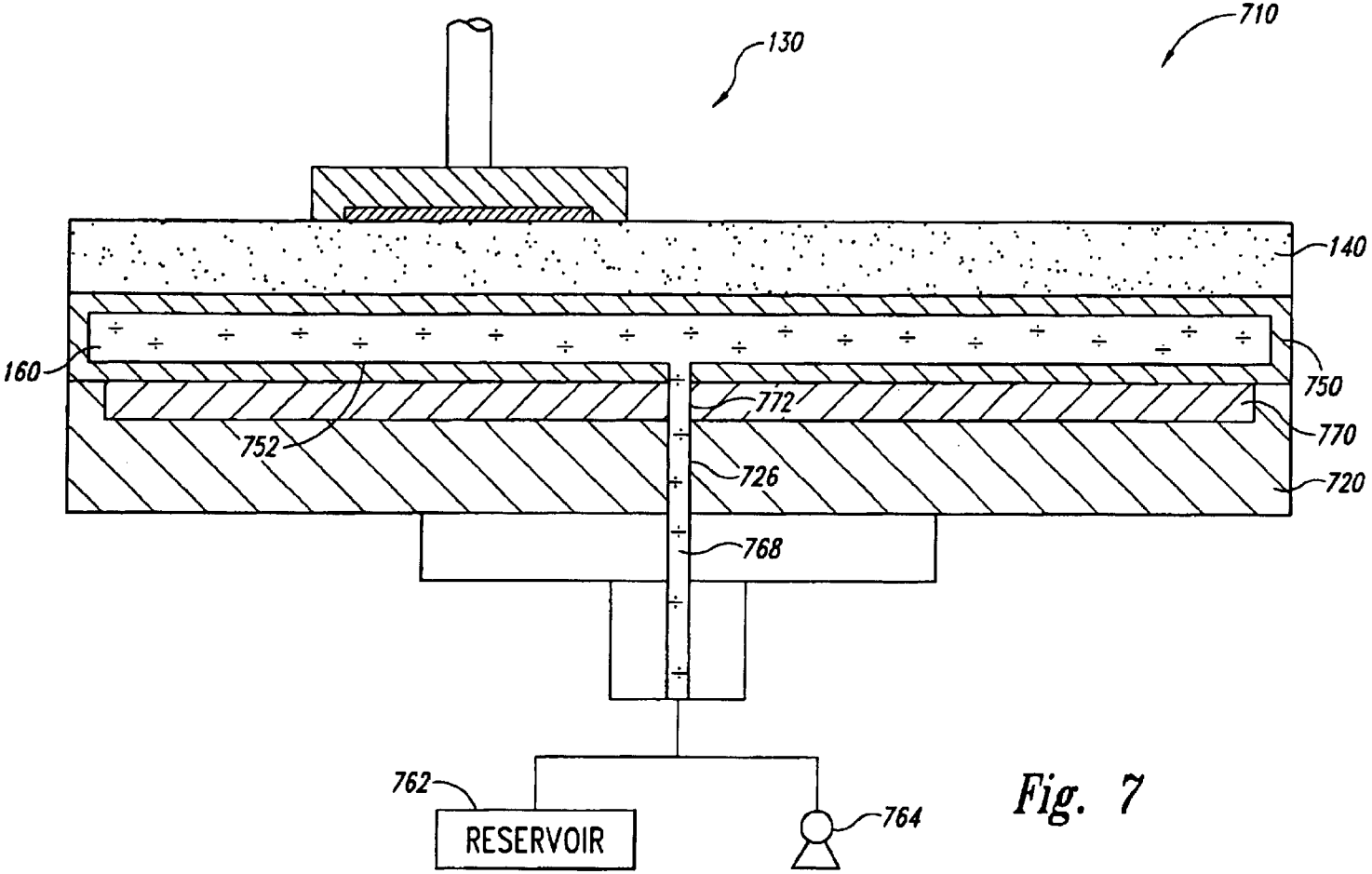
FIG. 7 is a schematic cross-sectional view of a portion of a CMP machine in accordance with yet another embodiment of the invention.

FIG. 7 is a schematic cross-sectional view of a CMP machine 710 in accordance with another embodiment of the invention. The CMP machine 710 can be similar to the CMP machine 110 discussed above with reference to FIG. 2. For example, the CMP machine 710 includes a workpiece carrier assembly 130, a planarizing pad 140, an under-pad 750 carrying the planarizing pad 140, a platen 720 carrying the under-pad 750, and a magnetic field source 770 carried by the platen 720. The under-pad 750 has a cavity 752 containing a magnetorheological fluid 160. The CMP machine 710 further includes a reservoir 762 in fluid communication with the cavity 752 and a pump 764 to transfer the magnetorheological fluid 160 between the cavity 752 and the reservoir 762. A conduit 768 extending through an aperture 726 in the platen 720 and an aperture 772 in the magnetic field source 770 couples the cavity 752 to the reservoir 762 and the pump 764. The pump 764 can transfer a portion of the magnetorheological fluid 160 from the reservoir 762 to the cavity 752 to increase the pressure in the cavity 752. The increased pressure in the cavity 752 accordingly reduces the compressibility of the under-pad 750. Alternatively, the pump 764 can transfer a portion of the magnetorheological fluid 160 from the cavity 752 to the reservoir 762 to increase the compressibility of the under-pad 750.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A method of polishing a microfeature workpiece with a polishing machine having a carrier head, a polishing pad, and an under-pad carrying the polishing pad, the method comprising:

moving at least one of the carrier head and the polishing pad relative to the other to rub the microfeature workpiece against the polishing pad, the under-pad having a cavity and a magnetorheological fluid in the cavity, the cavity including a plurality of discrete cells arranged in a grid having at least two rows of cells and at least two columns of cells; and changing the compressibility of the under-pad by generating a magnetic field to change the viscosity of the magnetorheological fluid within the cavity of the under-pad.

2. The method of claim 1 wherein generating the magnetic field comprises energizing an electromagnet to generate the magnetic field in the cavity.

3. The method of claim 1 wherein generating the magnetic field comprises energizing an electrically conductive coil to generate the magnetic field in the cavity.

4. The method of claim 1 wherein:

the magnetic field comprises a first magnetic field;

changing the compressibility of the under-pad comprises changing the compressibility of the under-pad in a first region; and the method further comprises changing the compressibility of the under-pad in a second region by generating a second magnetic field to change the viscosity of the magnetorheological fluid within the second region of the under-pad, the second region of the under-pad being different than the first region.

5. The method of claim 1 wherein generating the magnetic field comprises generating the magnetic field with a magnetic field source carried by a table coupled to the under-pad.

6. The method of claim 1 wherein generating the magnetic field comprises generating the magnetic field with a magnetic field source carried by the under-pad.

7. A method of polishing a microfeature workpiece with a polishing machine having a carrier head, a polishing pad, and an under-pad carrying the polishing pad, the method comprising:

moving at least one of the carrier head and the polishing pad relative to the other to rub the microfeature workpiece against the polishing pad, the under-pad having a cavity and a magnetorheological fluid in the cavity; and dynamically modulating the compressibility of the under-pad by changing the viscosity of the magnetorheological fluid within the cavity of the under-pad with a magnetic field source, the magnetic field source including a plurality of electromagnets arranged in a grid having at least two rows of cells and at least two columns of cells.

8. The method of claim 7 wherein dynamically modulating the compressibility of the under-pad comprises energizing at least one of the electromagnets to generate a magnetic field in the cavity.

9. A method of polishing a microfeature workpiece with a polishing machine having a carrier head, a polishing pad, and an under-pad carrying the polishing pad, the method comprising:

moving at least one of the carrier head and the polishing pad relative to the other to rub the microfeature workpiece against the polishing pad, the under-pad having a cavity with a plurality of discrete cells and a magnetorheological fluid in at least one of the cells, the discrete cells being arranged in a grid having at least two rows and at least two columns; and dynamically modulating the compressibility of a region of the under-pad by changing the viscosity of the magnetorheological fluid within a corresponding cell of the under-pad.

10. The method of claim 9 wherein dynamically modulating the compressibility of the region of the under-pad comprises energizing an electromagnet to generate a magnetic field in the corresponding cell.

11. The method of claim 9 wherein dynamically modulating the compressibility of the region of the under-pad comprises energizing an electrically conductive coil to generate a magnetic field in the corresponding cell.

12. A method of polishing a microfeature workpiece with a polishing machine having a carrier head, a polishing pad, and an under-pad carrying the polishing pad, the carrier head carrying a magnetic field source and the under-pad having a cavity and a magnetorheological fluid in the cavity, the method comprising:

moving at least one of the carrier head and the polishing pad relative to the other to rub the microfeature workpiece against the polishing pad with the under-pad having a first hardness until a surface of the microfeature is at least generally planar; and moving at least one of the carrier head and the polishing pad relative to the other to rub the microfeature workpiece against the polishing pad with the under-pad having a second hardness until a surface of the microfeature has reached an endpoint, wherein the first hardness is different than the second hardness.

13. The method of claim 12, further comprising changing the viscosity of the magnetorheological fluid in the cavity to change the hardness of the under-pad from the first hardness to the second hardness.

14. The method of claim 12 wherein moving at least one of the carrier head and the polishing pad with the under-pad having the first hardness occurs before moving at least one of the carrier head and the polishing pad with the under-pad having the second hardness.

15. A polishing machine for mechanical and/or chemical-mechanical polishing of microfeature workpieces, the machine comprising:

a table having a support surface;

an under-pad carried by the support surface of the table, the under-pad having a cavity;

a workpiece carrier assembly over the table, the carrier assembly configured to carry a microfeature workpiece;

a magnetic field source configured to generate a magnetic field in the cavity; and a magnetorheological fluid in the cavity;

wherein the cavity comprises a plurality of discrete cells arranged in a grid having at least two rows of cells and at least two columns of cells.

16. The polishing machine of claim 15 wherein the magnetic field source comprises a plurality of electromagnets arranged concentrically.

17. The polishing machine of claim 15 wherein the magnetic field source is carried by the table.

18. The polishing machine of claim 15 wherein the magnetic field source is carried by the under-pad.

19. A polishing machine for mechanical and/or chemical-mechanical polishing of microfeature workpieces, the machine comprising:

a table having a support surface;

an under-pad carried by the support surface of the table, the under-pad having a cavity;

a workpiece carrier assembly over the table, the carrier assembly configured to carry a microfeature workpiece;

a magnetic field source configured to generate a magnetic field in the cavity; and a magnetorheological fluid in the cavity;

wherein the magnetic field source comprises a plurality of electromagnets arranged in a grid having at least two rows of cells and at least two columns of cells.

20. The polishing machine of claim 19 wherein the cavity comprises a plurality of discrete cells arranged generally concentrically.

21. A polishing machine for mechanical and/or chemical-mechanical polishing of microfeature workpieces, the machine comprising:

a table;

an under-pad coupled to the table, the under-pad having an enclosed cavity;

a polishing pad for polishing a microfeature workpiece, the polishing pad being coupled to the under-pad;

a workpiece carrier assembly having a drive system and a carrier head coupled to the drive system, the carrier head being configured to hold the microfeature workpiece and the drive system being configured to move the carrier head to engage the microfeature workpiece with the polishing pad, wherein the carrier head and/or the table is movable relative to the other to rub the microfeature workpiece against the polishing pad;

a viscosity controller at least proximate to the under-pad; and a fluid in the enclosed cavity, wherein the viscosity of the fluid in the enclosed cavity changes under the influence of the viscosity controller;

wherein the enclosed cavity comprises a plurality of discrete cells arranged in a grid having at least two rows of cells and at least two columns of cells.

22. The polishing machine of claim 21 wherein the viscosity controller selectively generates a magnetic field in the cavity.

23. The polishing machine of claim 21 wherein the viscosity controller comprises an electromagnet to generate a magnetic field in the cavity.

24. The polishing machine of claim 21 wherein the viscosity controller comprises an electrically conductive coil to generate a magnetic field in the cavity.

25. The polishing machine of claim 21 wherein the viscosity controller comprises a plurality of electromagnets arranged concentrically.

26. The polishing machine of claim 21 wherein the change in the viscosity of the fluid changes the compressibility of the under-pad.

27. A polishing machine for mechanical and/or chemical-mechanical polishing of microfeature workpieces, the machine comprising:

a table having a support surface;

an under-pad carried by the support surface of the table, the under-pad having a cavity;

a workpiece carrier assembly over the table, the carrier assembly configured to carry a microfeature workpiece;

a magnetic field source configured to generate a magnetic field in the cavity; and a magnetorheological fluid in the cavity;

wherein the magnetic field source is carried by the workpiece carrier assembly.

28. The polishing machine of claim 27 wherein the under-pad further includes a first surface and a second surface opposite the first surface, and wherein the cavity is enclosed between the first and second surfaces.

29. The polishing machine of claim 27 wherein the magnetic field source comprises an electromagnet configured to generate the magnetic field in the cavity.

30. The polishing machine of claim 27 wherein the magnetic field source comprises an electrically conductive coil configured to generate the magnetic field in the cavity.

31. The polishing machine of claim 27 wherein the change in the viscosity of the magnetorheological fluid changes the compressibility of the under-pad.

32. A polishing machine for mechanical and/or chemical-mechanical polishing of microfeature workpieces, the machine comprising:

a table;

an under-pad coupled to the table, the under-pad having an enclosed cavity;

a polishing pad for polishing a microfeature workpiece, the polishing pad being coupled to the under-pad;

a workpiece carrier assembly having a drive system and a carrier head coupled to the drive system, the carrier head being configured to hold the microfeature workpiece and the drive system being configured to move the carrier head to engage the microfeature workpiece with the polishing pad, wherein the carrier head and/or the table is movable relative to the other to rub the microfeature workpiece against the polishing pad;

a viscosity controller at least proximate to the under-pad; and a fluid in the enclosed cavity, wherein the viscosity of the fluid in the enclosed cavity changes under the influence of the viscosity controller;

wherein the viscosity controller comprises a plurality of electromagnets arranged in a grid having at least two rows of cells and at least two columns of cells.

33. The polishing machine of claim 32 wherein the enclosed cavity comprises a plurality of discrete cells arranged generally concentrically.

34. An under-pad for use on a polishing machine in the mechanical and/or chemical-mechanical polishing of microfeature workpieces, the under-pad comprising:

a body including a first surface, a second surface juxtaposed to the first surface, and a cavity between the first and second surfaces;

a magnetorheological fluid in the cavity; and a magnetic field source carried by the body for selectively generating a magnetic field in the cavity;

wherein the cavity comprises a plurality of discrete cells arranged in a grid.

35. The under-pad of claim 34 wherein the first surface is spaced apart from the second surface by a distance of between approximately 0.5 millimeter to approximately 10 millimeters.

36. The under-pad of claim 34 wherein the magnetic field source comprises an electrically conductive coil carried by the body, wherein the electrically conductive coil is configured to generate a magnetic field in the cavity.

37. The under-pad of claim 34 wherein the cavity comprises a plurality of discrete cells arranged generally concentrically.

38. The under-pad of claim 34 wherein the magnetorheological fluid changes viscosity to modulate the compressibility of the under-pad.

39. A polishing machine for mechanical and/or chemical-mechanical polishing of microfeature workpieces, the machine comprising:

a table having a support surface;

an under-pad carried by the support surface of the table, the under-pad having a plurality of discrete cavities;

a workpiece carrier assembly over the table for carrying a microfeature workpiece;

a plurality of magnetic field sources configured to generate magnetic fields in corresponding cavities; and a magnetorheological fluid in at least one of the cavities;

wherein the discrete cavities are arranged in a grid having at least two rows of cells and at least two columns of cells.

40. The polishing machine of claim 39 wherein the magnetic field sources are arranged generally concentrically.

41. The polishing machine of claim 39 wherein the magnetic field sources comprise a plurality of electrically conductive coils configured to generate magnetic fields in corresponding cavities.

42. A polishing machine for mechanical and/or chemical-mechanical polishing of microfeature workpieces, the machine comprising:

a table having a support surface;

an under-pad carried by the support surface of the table, the under-pad having a plurality of discrete cavities;

a workpiece carrier assembly over the table for carrying a microfeature workpiece;

a plurality of magnetic field sources configured to generate magnetic fields in corresponding cavities; and a magnetorheological fluid in at least one of the cavities;

wherein the magnetic field sources are arranged in a grid having at least two rows of cells and at least two columns of cells.

43. The polishing machine of claim 42 wherein the discrete cavities are arranged generally concentrically.

44. The polishing machine of claim 42 wherein the magnetic field sources comprise a plurality of electromagnets configured to generate magnetic fields in corresponding cavities.

* * * * *